US008196524B2

(12) United States Patent
Wiesand

(10) Patent No.: US 8,196,524 B2
(45) Date of Patent: Jun. 12, 2012

(54) CLOSED-LOOP CONTROL OF A PNEUMATIC SPRING

(75) Inventor: Manfred Wiesand, Burgthann (DE)

(73) Assignee: Siemens Aktiengesellschaft, Munich (DE)

( * ) Notice: Subject to any disclaimer, the term of this patent is extended or adjusted under 35 U.S.C. 154(b) by 224 days.

(21) Appl. No.: 12/522,017

(22) PCT Filed: Jan. 2, 2008

(86) PCT No.: PCT/EP2008/050017

§ 371 (c)(1),
(2), (4) Date: Jul. 2, 2009

(87) PCT Pub. No.: WO2008/081019

PCT Pub. Date: Jul. 10, 2008

(65) Prior Publication Data

US 2010/0102520 A1 Apr. 29, 2010

(30) Foreign Application Priority Data

Jan. 3, 2007 (DE) ..... 10 2007 001 342

(51) Int. Cl.
*B61F 1/00* (2006.01)
*F16F 9/43* (2006.01)
*B60G 17/00* (2006.01)

(52) U.S. Cl. ..... 105/453; 267/64.28; 280/6.15

(58) Field of Classification Search ..... 105/453; 267/64.28; 280/6.15, 6.151, 6.153
See application file for complete search history.

(56) References Cited

U.S. PATENT DOCUMENTS

| | | | | |
|---|---|---|---|---|
| 4,091,738 | A * | 5/1978 | Platner | 105/164 |
| 5,141,245 | A | 8/1992 | Kamimura et al. | |
| 5,193,849 | A * | 3/1993 | Holzmann | 280/6.152 |
| 5,769,400 | A * | 6/1998 | Holzl et al. | 267/64.16 |
| 6,550,394 | B1 * | 4/2003 | Polley | 105/164 |
| 6,883,810 | B2 | 4/2005 | Svartz | |
| 2006/0108749 | A1 | 5/2006 | Kim | |

FOREIGN PATENT DOCUMENTS

| | | | |
|---|---|---|---|
| DE | 1455140 | A1 | 4/1969 |
| DE | 3934483 | A1 | 4/1990 |

(Continued)

OTHER PUBLICATIONS

German Office Action dated Jul. 31, 2009.

(Continued)

*Primary Examiner* — S. Joseph Morano
*Assistant Examiner* — Robert McCarry, Jr.
(74) *Attorney, Agent, or Firm* — Laurence A. Greenberg; Werner H. Stemer; Ralph E. Locher

(57) ABSTRACT

A device has a pneumatic spring for supporting a load on a bogie of a rail vehicle and a compressed air supply which is pneumatically connected to the air spring via an air spring valve in order to vent and to fill the air spring with compressed air. A closed-loop control unit adjusts the air volume and/or the air pressure in the air spring. A compressed air line provides for the pneumatic connection between the compressed air supply, air spring, air spring valve and control unit. Unnecessary filling and venting of the air spring is prevented by way of a device for limiting the volume flow into the compressed air line in dependence on the speed of the rail vehicle.

11 Claims, 1 Drawing Sheet

FOREIGN PATENT DOCUMENTS

| | | | |
|---|---|---|---|
| DE | 19544622 | C1 | 9/1996 |
| DE | 10330432 | A1 | 2/2005 |
| EP | 0354438 | A1 | 2/1990 |
| EP | 1659007 | A2 | 5/2006 |
| GB | 1087579 | A | 10/1967 |
| JP | 2006327391 | A | 12/2006 |
| KR | 20050010187 | A | 1/2005 |
| RU | 2001785 | C1 | 10/1993 |
| SU | 1505802 | A1 | 9/1989 |
| SU | 1551566 | A1 | 3/1990 |
| WO | 2004041563 | A1 | 5/2004 |

OTHER PUBLICATIONS

German Office Action dated Jun. 29, 2007.
International Search Report dated Apr. 9, 2008.

* cited by examiner

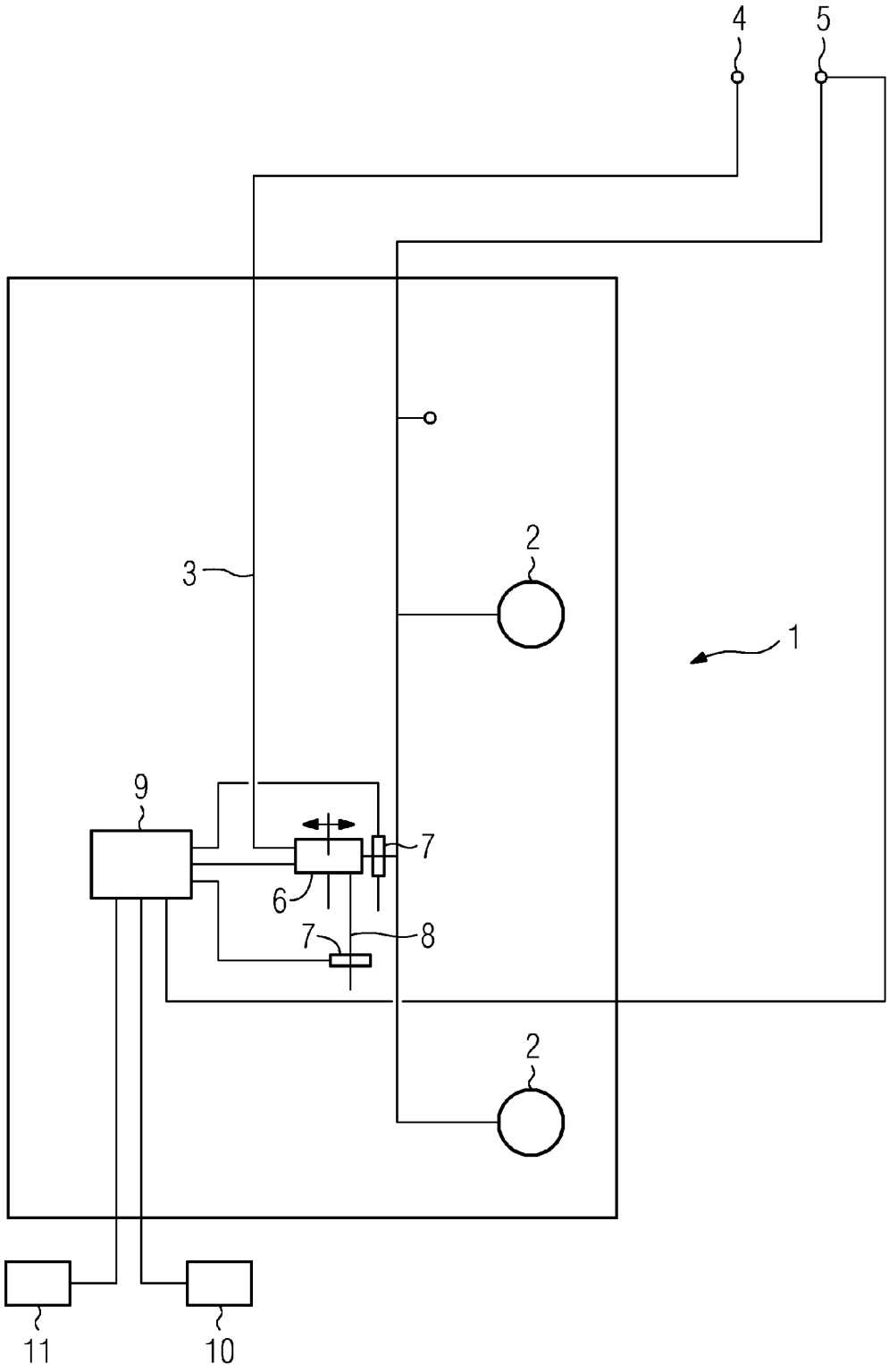
4
5
3
2
1
9
7
6
7
8
2
11
10

CLOSED-LOOP CONTROL OF A PNEUMATIC SPRING

BACKGROUND OF THE INVENTION

Field of the Invention

The invention relates to a device having a pneumatic spring for supporting a load on a bogie of a rail vehicle, a compressed air supply which is pneumatically connected to the pneumatic spring via a pneumatic spring valve in order to vent or fill the pneumatic spring with compressed air, and a closed-loop control unit for adjusting the air volume and/or the air pressure in the pneumatic spring, wherein the ventilation and venting of the pneumatic spring take places via at least one compressed air line.

The invention also relates to a method for controlling the air pressure and the air volume of a pneumatic spring of a rail vehicle in which a control unit accesses a pneumatic spring valve which communicates with the pneumatic spring and a compressed air supply, wherein at least one compressed air line is provided for ventilating and venting the pneumatic spring.

Such a device and such a method are already known from the accepted prior art. For example, the suspension system of a rail vehicle for conveying persons generally comprises a mechanically configured primary spring and a secondary pneumatic spring. The pneumatic spring permits not only additional damping but also ride level control of the rail car body for compensating for different loads, said ride level control compressing the suspension system to differing degrees. The previously known device has the disadvantage that at high speeds of the rail vehicle centrifugal forces dynamically influence the level of the rail car body with respect to the bogie. When the vehicle travels through depressions, the level of the rail car body is, for example, dynamically lowered so that the pneumatic spring valve feeds in additional air in order to counteract the lowering of the rail car body. In contrast, when the vehicle travels over bumps the ground or the level of the rail car body is dynamically raised so that the pneumatic spring valve causes compressed air to be let out of the pneumatic spring. As a result of the dynamic loading, compressed air is therefore unnecessarily fed into the pneumatic spring or discharged into the atmosphere. However, a ride level control process while the vehicle is traveling is generally unnecessary.

BRIEF SUMMARY OF THE INVENTION

Taking the abovementioned prior art as a starting point, the invention is based on the object of avoiding unnecessary ventilation and venting of the pneumatic spring.

The invention achieves this object by means for limiting the volume flow in at least one of the compressed air lines as a function of the speed of the rail vehicle.

According to the invention, means are provided for limiting the airstream in one or more of the compressed air lines which serve to ventilate or to vent the pneumatic spring while it is being controlled. This limitation is dependent on the speed of the rail vehicle. Within the scope of the invention, the compressed air line which is assigned to the limiting means, and therefore the volume flow of the compressed air, is limited to a greater extent at high speeds of the rail vehicle than when the vehicle is traveling slowly. At high speeds, the dynamic loads when traveling through depressions or over bumps, and therefore the described and necessary ventilation and venting of the pneumatic spring, are greater than at slow speeds. The unnecessary ventilation and venting can therefore be reduced through the relatively severe limiting of the volume flow in the compressed air lines. In other words, the control becomes slower acting. If, as is customary at high speeds, the rail car body is raised only temporarily with respect to the bogie, the pneumatic spring valve is not able, owing to the relatively slow-acting nature of the compressed air stream, to let out a significant quantity of compressed air since, in the case of an electronic control unit, measuring sensors signal beforehand to the control unit that the level of the rail car body has, for example, reached its normal height again after the bump. The venting and ventilation is therefore limited, or even completely avoided, within the scope of the invention.

The means for limiting the volume flow are advantageously configured to constrict the compressed air line assigned to them, as soon as the rail vehicle exceeds a threshold speed. This form of limiting of the volume flow is one of the simplest and most cost-effective embodiments of the invention. The constriction of the compressed air line can be carried out with any desired valves which are known as such to a person skilled in the art so that further details do not need to be given on this at this point.

According to this embodiment of the invention, the constriction occurs when the speed of the rail vehicle exceeds a threshold speed. In contrast to this, within the scope of invention it is also possible to select more complicated methods for detecting the state in which the rail vehicle has assumed a speed in which undesired and unnecessary venting or ventilation of the pneumatic spring occurs. For this purpose, the evaluation unit has a logic which is implemented in it and which detects this state with reference to the measured values and the predefined setpoint values.

The measuring sensors advantageously comprise door sensors, wherein the door sensors are configured to generate a release signal when the doors of the rail vehicle are opened. The measuring sensors and/or the release signal do not have to be made available separately. Instead, it is expedient within the scope of the invention to have recourse to measuring sensors or release signals which are present in any case. The release signal causes, for example, a compressed air line for ventilation to be shut off by an expedient control valve so that a volume flow through the compressed air line is completely prevented. A ride level control process while the vehicle is traveling is dispensed with entirely according to this advantageous embodiment of the device according to the invention.

The control unit is advantageously a mechanical control unit. For the purpose of mechanical control, the pneumatic spring valve is mechanically connected to a rail car body of a rail vehicle via, for example, a lever mechanism parallel to the pneumatic spring. The rail car body is supported on bogies by means of a primary spring and the pneumatic spring. Said springs are compressed to a greater extent in the event of additional loading of the rail car body, with the result that the rail car body is lowered. This lowering movement is introduced into the pneumatic spring valve via said lever mechanism, with the result that said pneumatic spring valve is expediently actuated and consequently ensures that the pneumatic spring is ventilated and the rail car body is raised. This permits the load-induced lowering of the rail car body to be compensated for.

In a variant of the invention which differs therefrom, the control unit is an electronic control unit which has measuring sensors for measuring an air pressure and/or air volume of the pneumatic spring. The control unit also has an expedient logic, for example in the form of software, which is implemented on a programmable arithmetic unit. The measuring sensors provide the software with actual values which are compared with corresponding setpoint values. As a function of the difference between the setpoint value and actual value, a suitable controller actuates the pneumatic spring valve which, for example, can be addressed electronically.

The pneumatic spring valve is advantageously connected to the external atmosphere via an outlet pipeline, wherein the means for limiting the volume flow limit the volume flow of the outlet pipeline. The limiting of the volume flow in the outlet pipeline assists, for example, the limiting of the compressed air line for ventilating the pneumatic spring. In contrast to this, within the scope of the invention the limiting of the volume flow of the outlet pipeline is also alone adequate for preventing unnecessary venting of the pneumatic spring.

The invention achieves this object on the basis of the method mentioned at the beginning in that the volume flow in at least one of the compressed air lines is limited as a function of the speed of the rail vehicle.

According to one embodiment of the invention, the volume flow in the respective compressed air line is interrupted if the speed of the rail vehicle exceeds a threshold speed. As has already been stated, this is a particularly cost-effective variant of the method according to the invention. However, apart from the comparison of speed, other evaluation methods which detect a state in which unnecessary ventilation and venting of the pneumatic spring occurs are also possible.

The volume flow in the assigned compressed air line is advantageously limited to a relatively low value. According to this advantageous development, at least a certain ride level control is possible even at relatively high speeds, and leaks in the pneumatic spring system can be compensated for, while, however, unnecessary venting is largely avoided.

According to one expedient development, the air stream in the assigned compressed air line is dynamically adapted to the speed of the rail vehicle. According to this embodiment, for example a valve is provided which permits continuous constriction of the compressed air line, or else a stepped constriction is provided so that certain constriction steps can be actuated selectively. This configuration of the method according to the invention permits gradual adaptation of the pneumatic spring control to the high speed situation in which the greatest unnecessarily discharged volumes of compressed air can occur. However, when the vehicle is traveling slowly the driving comfort is maintained.

In contrast to this, the volume flow is limited as soon as a door release signal signals that all the doors of the vehicle are closed, and therefore the static load on the pneumatic spring no longer changes due to passengers entering or leaving the train. This means, in other words, that as soon as the train begins to move, the volume flow in the assigned compressed air line is limited or interrupted. According to this embodiment, the ride level control is then switched off directly after the train leaves the station.

As has already been stated, it is also possible within the scope of the invention for the volume flow to be limited as soon as the rail vehicle exceeds a previously defined threshold speed. A ride level control is then only made available, for example, below 100 km/h.

According to one preferred variant of the method according to the invention, the volume flow of the assigned compressed air line is completely interrupted.

Further expedient embodiments and advantages of the invention are the subject matter of the following description of exemplary embodiments of the invention with reference to the appended FIGURE in the drawing, in which

BRIEF DESCRIPTION OF THE DRAWING

The FIGURE shows a schematic illustration of an exemplary embodiment of the device according to the invention.

DESCRIPTION OF THE INVENTION

The FIGURE is a schematic illustration of an exemplary embodiment of the device 1 according to the invention, which has a pneumatic spring 2 which is composed of two parts and which is attached to a bogie (not shown in the FIGURE). A rail car body (not illustrated either) is supported on the pneumatic spring 2, with the pneumatic spring 2 being configured, together with a primary spring system which is composed, for example, of helical springs, to provide suspension and damping for the rail car body on the bogie.

The pneumatic spring 2 communicates by means of a compressed air line 3 with a compressed air supply 4 which is indicated only schematically in the FIGURE. The cargo or load of the rail car body is measured by means of a measuring sensor 5 with which the pressure in the pneumatic spring can be determined. By means of the pressure it is possible to infer the cargo of the rail car body. In order to adjust the pressure and the volume of compressed air in the pneumatic spring 2, a pneumatic spring valve 6 is provided, wherein the pneumatic spring 2 is vented via the outlet pipeline 8 as an additional compressed air line. The pneumatic spring valve 6 is connected to a control unit 9 to which the measuring sensor 5 is also connected. For example a ride level control is made possible with the control unit 9 so that, for example in the event of an increased cargo of the rail car body, lowering of the level of the rail car body as a result of the compression of the primary spring can be compensated for. For this purpose, the control unit feeds the pressure value, made available by the measuring sensor 5, to a logic which is stored in the control unit and which brings about an increase in the pressure by means of pneumatic spring valve 6 by means of setpoint values and the pressure value.

In a different exemplary embodiment of the invention (not clarified in the FIGURE), the control unit is of purely mechanical design, wherein the pneumatic spring valves are mechanically connected to the rail car body by means of a lever and a linkage parallel to the pneumatic spring. Whenever the level changes, the pneumatic spring valve is therefore actuated by means of the linkage and the lever, and said pneumatic spring valve then ventilates or vents the pneumatic spring.

Furthermore, the control unit 9 is connected to shut-off valves 7, which are arranged both in the compressed air line 3 and in the outlet pipeline 8. If the control unit 9 actuates the shut-off valves 7 with a shut-off signal, the shut-off valves 7 close the compressed air lines 3 and 8 so that the pneumatic connection of the pneumatic spring 2 to the compressed air supply 4 or to the external atmosphere is interrupted. Furthermore, the evaluation unit is connected to a door sensor 10 which transmits the state of the doors of the rail vehicle, that is to say "doors open" or "door closed" to the control unit by means of corresponding signals. The control unit also actuates the shut-off valves 7 to open on the basis of a logic stored in said control unit 9 if the door sensors indicate that the doors of the rail vehicle are opened. In this case, the compressed air control of the pneumatic spring 2 is enabled and ride level control is made available by the control unit 9. However, as soon as the doors of the rail vehicle close, the control unit 9 actuates the shut-off valves 7 to shut off the compressed air lines 3 and 8 so that unnecessary ride level control and therefore unnecessary ventilation and venting of the pneumatic spring 2 is prevented.

As has already been stated, it is also possible for the volume flow to be limited by the control unit 9 as soon as the rail vehicle exceeds a previously defined threshold speed determined by a speed detecting sensor 11.

The invention claimed is:

1. A device, comprising:

a pneumatic spring for supporting a load of a bogie of a rail vehicle;

a compressed air supply pneumatically connected to said pneumatic spring via a pneumatic spring valve configured to selectively vent or pressurize said pneumatic spring with compressed air;

a closed-loop control unit for adjusting an air volume and/or an air pressure in said pneumatic spring;

a compressed air line connected for pressurizing and/or venting said pneumatic spring; and a limiter device for limiting a volume flow in said compressed air line in dependence on a speed of the rail vehicle, said limiter device for limiting the volume flow being configured to constrict said compressed air line when the rail vehicle goes above a threshold speed.

2. The device according to claim 1, which comprises measuring sensors including door sensors configured to generate a release signal when the doors of the rail vehicle are opened.

3. The device according to claim 1, wherein said control unit is a mechanical control unit.

4. The device according to claim 1, wherein said control unit is an electronic control unit comprising measuring sensors for measuring an air pressure and/or an air volume of said pneumatic spring.

5. The device according to claim 1, wherein said pneumatic spring valve is connected to an atmospheric exterior via an outlet pipeline, and wherein said limiter device for limiting the volume flow is configured to limit a volume flow of said outlet pipeline.

6. A method of controlling an air pressure and an air volume of a pneumatic spring of a rail vehicle, the method which comprises:

accessing, with a control unit, a pneumatic spring valve in pneumatic communication with the pneumatic spring and a compressed air supply;

providing at least one compressed air line for pressurizing and venting the pneumatic spring; and limiting a volume flow in at least one of the compressed air lines in dependence on a speed of the rail vehicle; and interrupting the volume flow in the respectively assigned compressed air line if the rail vehicle goes above a given threshold speed.

7. The method according to claim 6, wherein the volume flow in the assigned compressed air line is limited to a relatively lower value.

8. The method according to claim 6, which comprises dynamically adapting the volume flow in the assigned compressed air line to the speed of the rail vehicle.

9. The method according to claim 6, which comprises limiting the volume flow as soon as a door release signal signals closed doors of the rail vehicle.

10. The method according to claim 6, which comprises limiting the volume flow as soon as the rail vehicle exceeds a predetermined threshold speed.

11. The method according to claim 6, which comprises completely interrupting the volume flow.

* * * * *